US010144607B2

(12) United States Patent
Hyötynen et al.

(10) Patent No.: US 10,144,607 B2
(45) Date of Patent: Dec. 4, 2018

(54) REEL-UP FOR REELING OF A FIBER WEB

(71) Applicant: Valmet Technologies Oy, Espoo (FI)

(72) Inventors: Sami Hyötynen, Ohope (NZ); Timo Hämäläinen, Järvenpää (FI); Vesa Riihelä, Halkia (FI); Risto Mäkinen, Mäntsälä (FI)

(73) Assignee: VALMET TECHNOLOGIES OY, Espoo (FI)

( * ) Notice: Subject to any disclaimer, the term of this patent is extended or adjusted under 35 U.S.C. 154(b) by 282 days.

(21) Appl. No.: 15/193,248

(22) Filed: Jun. 27, 2016

(65) Prior Publication Data

US 2016/0376117 A1 Dec. 29, 2016

(30) Foreign Application Priority Data

Jun. 26, 2015 (EP) ..... 15173982

(51) Int. Cl.
*B65H 18/20* (2006.01)
*B65H 19/22* (2006.01)

(52) U.S. Cl.
CPC ..... *B65H 19/2253* (2013.01); *B65H 18/20* (2013.01); *B65H 2301/414* (2013.01); *B65H 2301/41361* (2013.01)

(58) Field of Classification Search
CPC ..... B65H 18/20; B65H 19/2253; B65H 2301/414; B65H 2301/41361
See application file for complete search history.

(56) References Cited

U.S. PATENT DOCUMENTS

| | | | | |
|---|---|---|---|---|
| 5,069,394 | A | 12/1991 | Panttila et al. | |
| 5,370,327 | A | 12/1994 | Adamski | |
| 5,673,870 | A | 10/1997 | Fielding et al. | |
| 5,967,449 | A * | 10/1999 | Thomas | B65H 18/26 242/541.1 |
| 2004/0041055 | A1* | 3/2004 | Kojo et al. | B65H 19/2253 242/541.1 |
| 2008/0251628 | A1* | 10/2008 | Kemppainen | B65H 18/22 242/542.3 |

FOREIGN PATENT DOCUMENTS

| | | | |
|---|---|---|---|
| EP | 0483092 | A1 | 4/1992 |
| WO | 2009080890 | A1 | 7/2009 |
| WO | 2010000915 | A1 | 1/2010 |

OTHER PUBLICATIONS

Extended European Search Report for EP15173982 dated Jan. 8, 2016.

* cited by examiner

*Primary Examiner* — Sang K Kim
(74) *Attorney, Agent, or Firm* — Stiennon & Stiennon

(57) ABSTRACT

A reel-up for reeling of a fiber web (W) around a reel spool (15B) to form a parent roll (20B; 20A) by use of a reeling nip (N) between a reeling cylinder (10) of the reel-up and the parent roll (20B) under reeling, has a primary reeling position and a secondary reeling position. The reel-up (10) has the reeling cylinder (10), substantially horizontal guides (14) and for each end of the reel spool (15A; 15B), loading arms (12,13; 16,17) and carriages (18) and the primary reeling position is fixed.

7 Claims, 2 Drawing Sheets

20A
15A
16
17
18
14
N
S
20B
15B
10
11
12
13
W
15C

REEL-UP FOR REELING OF A FIBER WEB

CROSS REFERENCES TO RELATED APPLICATIONS

This application claims priority on European Patent App. No. EP 15173982, filed Jun. 26, 2015, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a reel-up for reeling of a fiber web. Especially the invention relates to a reel-up for reeling of a fiber web around a reel spool to form a parent roll by use of a reeling nip between a reeling cylinder of the reel-up and the parent roll under reeling, which reel-up has a primary reeling position and a secondary reeling position, which reel-up comprises the reeling cylinder, substantially horizontal guides and for each end of the reel spool loading arms and carriages.

As known from the prior art, fiber web producing processes typically comprise an assembly formed by a number of apparatuses arranged consecutively in the process line. A typical production and treatment line comprises a head box, a wire section and a press section as well as a subsequent drying section and a reel-up. The production and treatment line can further comprise other sections and devices for finishing the fiber web, for example a sizer, a coating device, and a calender. The production and treatment line also comprises at least one slitter-winder for forming customer rolls as well as a roll packaging apparatus. And, as known, fiber webs, such as paper or board webs, are manufactured in machines together forming a fiber web manufacturing line, which may be hundreds of meters long.

In fiber web manufacturing lines, manufacturing operates as a continuous process. The finished fiber web being output from the machine is wound with a reel-up around a reeling shaft, i.e. a reel spool, into a parent roll (a machine roll), the diameter of which may be more than 5 meters and which may weigh more than 160 tons. The purpose of the reeling is to transfer the fiber web from its planar manufacturing form into a form in which it can be handled more easily.

At the reel-up the continuous process of the machine is interrupted for the first time, after which the process continues in stages. Every attempt is made to interlink these stages as smoothly as possible. The reel-up typically comprises a reeling cylinder and two pairs of carriages or two pairs of forks or a pair of carriages and a pair of forks, one carriage/fork for each end of the reel spool/parent roll for moving and supporting the reel spool and the parent roll to be reeled. The web is reeled around the reel spool to a parent roll by means of a reeling nip between the reeling cylinder and the parent roll under reeling, which reeling takes place in a primary stage in a primary position and in a secondary stage in a secondary position. In most prior art arrangements the reel spool rotates during reeling on the guides supported by its rotating bearing housing.

The reel-up is thus a device that reels a material, which is produced as a continuous fiber web in a fiber web production line, into the form of a roll; the parent roll. In the production process of the fiber web, the reeling is generally a first process part, wherein a continuous process is discontinued to be continued in sequences. The parent roll is formed around the reeling shaft that functions as a core of reeling, i.e. the fiber web on one parent roll has a beginning and an end. At a reel-up a certain amount of fiber web is wound around the reel spool, typically without slowing down the running speed of the fiber web, after which the so-called turn-up is performed, in which the web is cut and directed to be reeled around a new empty reel spool. The smooth operation of the reel-up and especially the turn-up is very critical with regard to the function of the entire production line and, it is therefore important that handling of the reel spools, the parent rolls under reeling and the finished parent rolls is reliable and such that the turn-up can be performed as required.

A prior art method described in the FI-patent 91383 (EP 0483092 B1) changed the size of parent rolls into a new order, since it was possible to build the first part of the parent roll without affecting the properties of the fiber web that was to be reeled. One feature that improved the technology was the progressive center torque of the parent roll that was provided by means of primary and secondary drives, enabling the versatile use of reeling parameters in building the parent roll. The prior art also discloses an example in which primary and secondary drives are engaged by a drive unit, with which the reeling shaft of the parent roll to be reeled is engaged during reeling with the help of a cylinder arrangement located in connection with transmission. This arrangement has been described in U.S. Pat. No. 5,069,394 and the drive arrangement is engageable and detachable by means of a cylinder device. In this kind of reel-up the primary center drive and the primary carriage as well as the secondary center drive and the secondary reeling carriage move simultaneously, since the center drive is mechanically constructed in connection with the carriage and they are moved by the same actuator.

A prior art method described in U.S. Pat. No. 5,370,327 introduced the idea that a parent roll would be built so that the parent roll would be on horizontal guides and at the same vertical height throughout the reeling. The present invention relates to this type of reel-up. FI-patent 91383 also presented this type of solution, but, before beginning to reel, the reeling shaft was moved along a curved path into its initial reeling position. In the reel-up according to the U.S. Pat. No. 5,370,327 a moving reeling cylinder makes it possible to keep the center of the reeling shaft on a constant level. One advantage of this solution is changing the adjustment of the nip power from loading on the side of the parent roll to loading on the side of a constant mass reeling cylinder.

In US patent publication 5,673,870 is disclosed a reel apparatus for reeling a traveling web produced on a paper-making machine, which comprises a rotatable support drum, which is fixedly mounted in a frame and a pair of parallel, horizontally disposed guides mounted to the frame with the tops of the guides above the apex of the support drum. New reel spools are brought into supporting engagement on the guides at a location downstream of the apex of the support drum and intermediate the apex of the support drum and a jumbo-sized wound web roll which is being wound while being powered by a center wind assist drive, as well as nipping engagement with the support drum. Each reel spool is supported in a pair of carriages which are mounted to travel over the guides. In the reel apparatus two sets of a complimentary pair of carriages can be disposed about a single pair of guides to handle two different reel spools simultaneously as one reel spool begins the web reeling process and the other reel spool is finished being wound.

In WO publication 2010000915 is disclosed a reel-up for continuous reeling of fiber web around a reeling shaft to form a parent roll, the reel-up comprising a reeling cylinder, whereby a nip load can be formed between the parent roll and the reeling drum cylinder, the parent roll being arranged so as to be movable during the reeling along a substantially horizontal path from the starting point of the reeling to the point of transfer of the completed parent roll, the starting point of the reeling being upstream of the reeling cylinder and the point of transfer downstream of the same. Upstream of the reeling cylinder, there are primary support means for supporting the parent roll against the reeling cylinder and downstream of the reeling drum, there are secondary forks for supporting the machine roll against the reeling drum.

In some types of known prior art reel-ups one possibility of moving the reeling shaft and the parent roll is to construct two carriage pairs, one carriage for each end of the reeling shaft/the parent roll for the movement. It is also known from prior art to construct for movements of the reeling shaft and the parent roll a combination of a carriage pair and a fork pair. In order to transfer the parent roll from one carriage to the other the paths of the carriages must be able to meet. One possibility known from prior art would be to construct one carriage pair outside the guides of the reel-up and another carriage pair inside the guides of the reel-up but in reel-ups with center drives the drives must be located outside the guides, which creates the problem of synchronizing the position between the center drive and the carriage pair moving inside the guides of the reel-up as the synchronizing is done electrically and it must be very accurate and stable, since otherwise the nip load of reeling is disturbed. The synchronizing can also be done mechanically by using two carriages for each carriage of a carriage pair; one carriage above and one carriage below the end of the reel spool but this construction is complicated and large and thus expensive. Synchronizing is necessary especially in change of the drive when the secondary drive is engaged to the parent roll in reeling speed. Two sets of carriages also increase the costs.

In the reel-ups according to prior art, for example according to those mentioned above, in the primary reeling position the reel spool around which the fiber web is reeled to form a parent roll is moved during reeling. This requires space and sets challenges for construction of the reel-up. This also lengthens the production line.

SUMMARY OF THE INVENTION

One object of the invention is to further develop reel-ups of the kinds of reel-ups in which the parent roll moves on substantially horizontal guides and is substantially at the same vertical height throughout the reeling, especially in relation to the possibility of moving the reeling shaft and the parent roll.

One object of the invention is to create a reel-up in which the disadvantages and problems of the reel-ups according to the prior art are eliminated or at least minimized.

An object of the invention is to create a reel-up for a fiber web which is simple, robust and reliable.

In order to achieve the above objects the reel-up has a primary reeling position which is fixed.

According to the invention the reel-up for reeling of a fiber web around a reel spool to form a parent roll by means of a reeling nip between a reeling cylinder of the reel-up and the parent roll under reeling has a primary reeling position and a secondary reeling position, which reel-up comprises the reeling cylinder, substantially horizontal guides and for each end of the reel spool loading arms and carriages and the primary reeling position is fixed.

According to an advantageous feature the loading arms comprise loading arms of the primary reeling position and loading arms of the secondary reeling position. According to an advantageous feature the loading arms of the secondary reeling position are located in the carriage.

According to an advantageous feature the loading arms comprise a substantially upright position, in which they provide a support position for the reel spool, and a substantially horizontal position, in which they provide a release position or a loading position for the reel spool.

According to an advantageous feature the loading arms of the primary reeling position are located inside the guides.

According to an advantageous feature the loading arms of the primary reeling position are located symmetrically, especially when center drives are used. In case center drives are not used the loading arms of the primary reeling position can also be located unsymmetrically.

According to an advantageous feature the loading arms of the secondary reeling position and the carriage are located outside the guides.

According to an advantageous feature the loading arms of the secondary reeling position and the carriages are located symmetrically, especially when center drives are used. In case center drives are not used the loading arms of the secondary reeling position can also be located unsymmetrically.

According to an advantageous feature movements of the carriages are substantially linear on the guides.

According to an advantageous feature the direction of the guides deviates from the horizontal direction +/−30°.

By the reel-up according to the invention and its advantageous features many advantages are achieved, for example costs are saved, since no primary carriage and constructional structures for it are needed and also the primary drive can be located on a fitted bed. It is also possible to provide more space between the reeling positions.

DESCRIPTION OF THE PREFERRED EMBODIMENTS

Figures 1A, 1B, 1C, 1D:
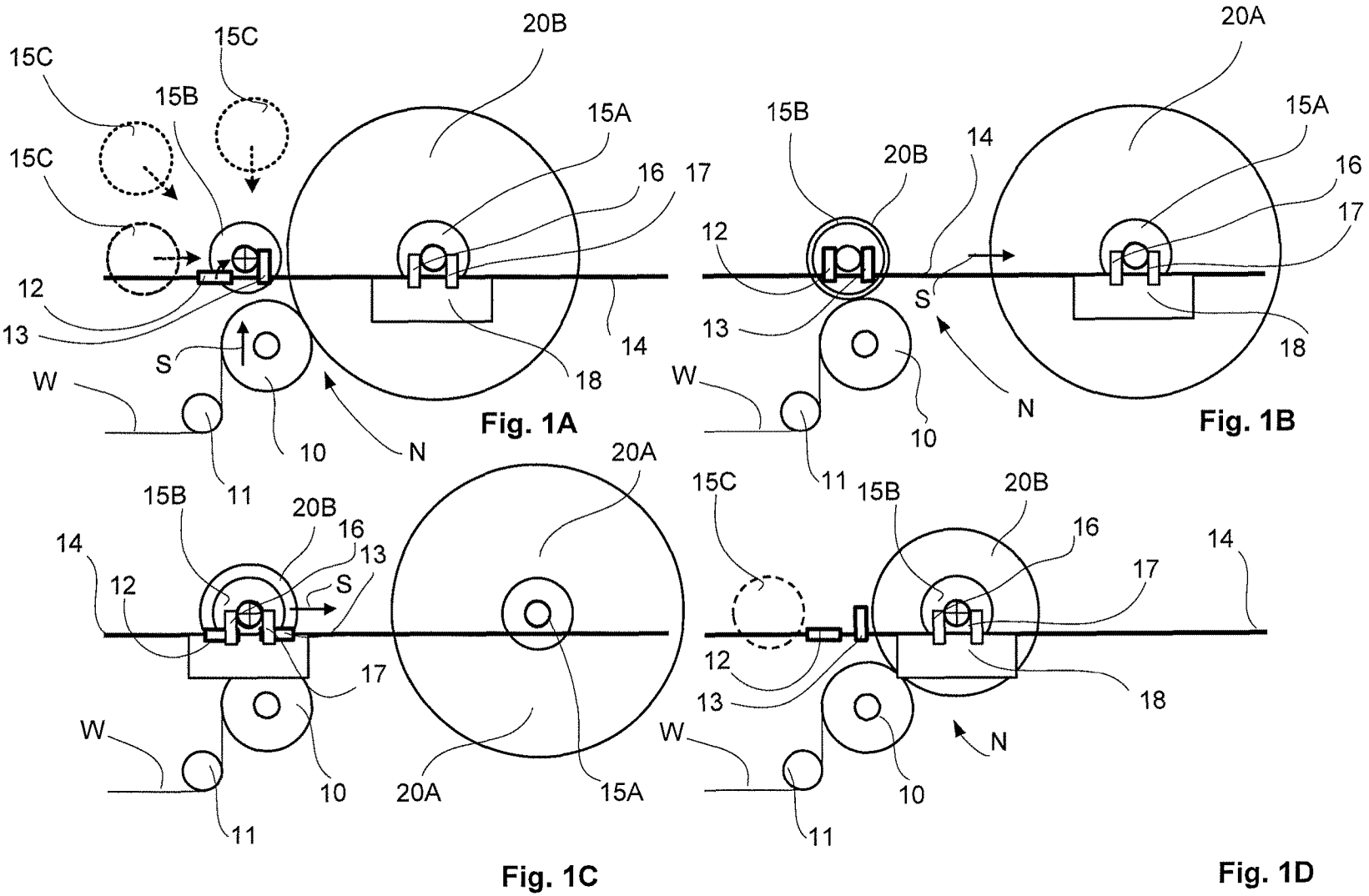
FIG. 1A-1D are schematic side views of a reel-up in accordance with an advantageous example of the invention showing the operation of the reel-up.

During the course of this description like numbers and signs will be used to identify like elements according to the different views which illustrate the invention.

In FIGS. 1A-1D and 2 is schematically shown an example of a reel-up comprising a reeling cylinder 10, a guide roll 11 for guiding the fiber web W onto the reeling cylinder 10. The reel-up also comprises at a primary reeling position primary loading arms 12, located in this case symmetrically inside transfer guides 14, and a primary drive and for the secondary reeling position secondary loading arms 16, 17 and a secondary drive located in one of the carriages 18.

The carriages 18 move linearly on advantageously substantially horizontal transfer guides 14. The transfer guides may deviate from the horizontal direction +/−30°. The loading arms 12, 13, 16, 17 and carriages 18 are located in connection with each of the transfer guides 14, i.e. in connection with each end of the reel spool 15A, 15B/the parent roll 20A/20B. The secondary loading arms 16, 17 and the carriages 18 are located in this case symmetrically outside the transfer guides 14.The fiber web W is reeled around a reel spool 15A, 15B to a parent roll 20A, 20BB by means of a reeling nip N between the reeling cylinder 10 and the parent roll 20A, 20B under reeling, which reeling takes place in a primary stage in a primary position and in a secondary stage in a secondary position. The reeling cylinder 10 is driven by known methods, typically by a motor (not shown). The reeling cylinder 10 rotates and the parent roll 20A, 20B is formed around a reel spool 15A, 15B. The nip load is formed between the parent roll 20A, 20B under reeling and the reeling cylinder 10 and it is provided by moving the reeling cylinder 10. The reel spool 15A, 15B is mounted on bearings in bearing housings resting on the substantially horizontal transfer guides 14. The reeling is started and a parent roll 20B under reeling is formed around the reel spool 15B supported in the primary loading arms 12, 13 first in the primary position, which is a fixed position i.e. the reel spool 15B is not moved during the reeling in the primary position and then at a certain, desired diameter transferred to support of secondary loading arms 16,17 in the carriages 18 to be reeled in the secondary position, in which the carriage moves the parent roll 20a, 20B under reeling along the substantially horizontal 10 transferring guides 14. The nip load is formed between the parent roll 20A, 20B under reeling and the reeling cylinder 10 and it is provided by moving carriages 18. A finished parent roll 20A is moved along the guides 14 to an end position at the end of the guides 14 wherefrom the finished parent roll 20A is transferred to the next process step.

The transferring guides 14 of the reel-up are substantially linear and transfer and reeling in the reel-up is thus provided along these substantially linear transfer guides 14. Empty reel spool 15C is brought to the primary reeling position, which is fixed in the machine direction for example along gravity based storage rails with stoppers, by a crane or from an upper storage, advantageously located above the reel-up, or by transfer arms, as shown by dashed line alternatives in the FIG. 1A. The reel spool 15B is located rotatably by primary loading arms 12, 13, which are advantageously located inside the transfer guides 14, into the primary in MD-direction fixed primary reeling position. The reeling cylinder 10 is moved upwards to form the reeling nip N between the parent roll 20B under reeling and the reeling cylinder 10. As the diameter of the parent roll 20B under reeling increases, the reeling cylinder 10 moves downwards but holding the reeling nip N in operation. When the diameter of the parent roll 20B under reeling reaches the desired limit the reeling is changed to the secondary reeling position. The reel spool 15B is moved to be supported by the secondary loading arms 16, 17 and the carriages 18 located outside the transfer guides 14. The movement of the carriages 18 is from the pick-up position from the primary reeling position to the position in which the finished parent roll 20A is relieved for further treatment. The stopping of rotation of the parent roll 20A is done advantageously in a separate break position, by which 35 the secondary loading arms 16, 17 and the carriage 18 can be earlier in the sequence released for the reeling of the next parent roll in the secondary reeling position. The parent roll 20A can also be stopped rotating in the secondary reeling position by the drive of the secondary reeling position. After the change of reeling position the reeling is continued in the secondary reeling position until the next change.

In FIG. 1A in the reel-up is shown in a situation, in which the reeling of a parent roll 20B in the secondary reeling position, in which the reel spool is in support of the secondary loading arms 16, 17 and the carriage 18. The reel spool 15A and thus also the parent roll 20B are rotated and moved by the secondary drive, is nearly finished and thus the diameter of the parent roll 20a is close to the desired diameter. New, empty reel spool 15C has been brought to the reel up to the primary reeling position for example along gravity based storage rails with stoppers, by a crane or from an upper storage, advantageously located above the reel-up and has been moved to the primary reeling position to be located into the support of the loading arms 12, 13. In FIG. 1A the loading arm 13 on the side of the secondary reeling position is in its upright position and supports the reel spool 15B. The reel spool 15B has been moved over the in moving direction first loading arm 12, which is in its horizontal position, to the primary reeling position. The reeling cylinder 10 is in reeling nip N position with the almost finished parent roll 20B in the secondary reeling position. The fiber web W is guided via a guide roll 11 onto the reeling cylinder 10 and into the reeling nip N and onto the parent roll 20B.

In FIG. 1B the reel-up is shown in a situation when the reeling of the fiber web W has been changed to the primary reeling position and the finished parent roll 20A supported in the loading arms 16, 17 of the secondary reeling position is moved along the guides 14 by the carriage 18 to be transferred to the next treatment stage. In the primary reeling position, which is fixed, the reel spool 15B and the parent roll 20B under reeling is supported by the loading arms 12, 13 of the primary reeling position and rotated by the center drive or a starter drive of the primary reeling position to the reeling speed. The reeling cylinder 10 has been moved in a substantially vertical direction upwards into reeling nip N contact with the parent roll 20B under reeling and as the reeling progresses the reeling cylinder 10 moves in a substantially vertical direction downwards. The fiber web W is guided by the guide roll 11 onto the reeling cylinder 10 and via the reeling nip onto the parent roll 20B under reeling.

In FIG. 1C the reel-up is shown in a situation when the finished parent roll 20A has been unloaded from the support of the loading arms 16, 17 of the secondary reeling position and of the carriage 18. The rotation of the parent roll has been stopped by a breaking device or by the center drive of the secondary reeling position. The carriage 18 has been moved to pick-up the parent roll 20B under reeling from the primary reeling position. The loading arms 12, 13 have been moved to their horizontal position and the reel spool 15B and the parent roll 20B under reeling have been changed to support of the loading arms 16, 17 and the carriage 18. The reel spool 15B and thus also the parent roll 20B under reeling are moved to the secondary reeling position. Also the reeling cylinder 10 is moved to form the reeling nip N with the parent roll 20B under reeling to the secondary reeling position. The fiber web W is guided by the guide roll 11 onto the reeling cylinder 10 and onto the parent roll 20B under reeling.

Figure 2:
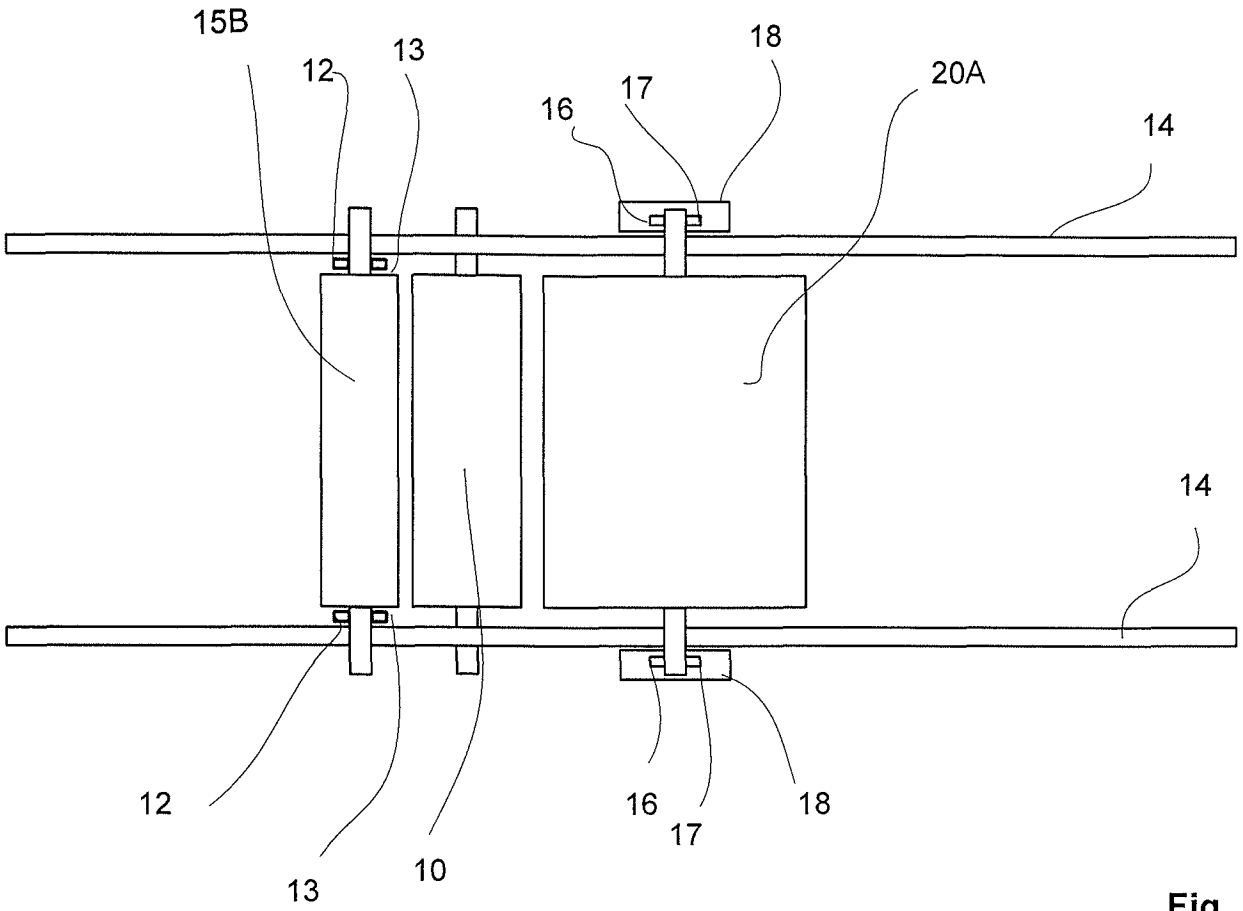
FIG. 2 is a schematic top view of the reel-up of FIGS. 1A-1D.

In FIG. 1D the reel-up is shown in a situation when the reeling of the fiber web W is continued in the secondary reeling position. The reel spool 15B and the parent roll under reeling 20B are in support of the loading arms 16, 17 and the carriage 18. The reel spool 15B and the parent roll under reeling 20B are rotated by the center drive of the secondary reeling position and moved by the carriage 18 as the reeling progresses. A new, empty reel spool 15C is brought to the primary reeling position for beginning of the reeling of the next parent roll. In FIG. 2 the reel-up is shown in a view from above. The reel spool 15B and the parent roll 20A are supported at each axial end on the guides 14. The reeling cylinder 10 is located below the guides 14. The loading arms 12, 13 of the primary reeling position are located in this case inside the guides and the loading arms 16, 17 and the carriages 18 are located outside the guides 14.

We claim:

1. A reel-up for reeling a fiber web around a reel spool to form a parent roll, comprising:

a first transfer guide and a second transfer guide arranged parallel to each other and extending in a machine direction and spaced apart in a cross direction;

a fixed primary reeling position, comprising:

a primary drive mounted to a bed fixed with respect to the first and second transfer guides, the primary drive arranged to cause a reel spool in the fixed primary reeling position to rotate;

a pair of first primary loading arms one of said first primary loading arms mounted along the first transfer guide and one of said first primary loading arms mounted along the second transfer guide;

a pair of second primary loading aims, one of said second primary loading aims mounted along the first transfer guide and one of said second primary loading arms mounted along the second transfer guide, wherein the second primary loading aims are spaced in the machine direction from the first primary loading aims;

wherein each first and second primary loading arm is mounted to rotate on a pivot fixedly mounted with respect to the first and second transfer guides, and rotatable between a first position where the primary loading aims engage at most one side of a reel spool, and a second position where the primary loading arms do not constrain the movement of a reel spool;

wherein while the first and second primary loading arms are engaged with a reel spool, the reel spool does not move in the machine direction;

wherein the first primary loading aims and the second primary loading arms are arranged to receive therebetween a reel spool, and to hold the reel spool in a fixed machine direction position with respect to the first transfer guide and the second transfer guide;

a reeling cylinder, mounted for vertical up and down motion below the reel spool as the reel spool is held fixed with respect to the first transfer guide and the second transfer guide between the first primary loading arms and the second primary loading arms, so that the reeling cylinder is upwardly moveable to engage the reel spool at a nip;

a guide member arranged to bring a fiber web into engagement with the reeling cylinder so that the fiber web wraps and passes through the nip and winds about the reel spool;

wherein the reeling cylinder is arranged to move downwardly as the fiber web forms a first part of a parent roll on the reel spool, with the first part of the parent roll in nipping engagement with the reeling cylinder;

a secondary reeling position, comprising:

a pair of carriages, one of which is movable alongside the first transfer guide and the other of which is movable alongside the second transfer guide, each of the carriages having an upstream and a downstream loading aim arranged to engage the reel spool and so hold the reel spool on the pair of carriages;

wherein the pair of carriages is arranged to hold the reel spool at the same time as the reel spool is released from the primary reeling position; and wherein after being released from the primary reeling position the pair of carriages is arranged to move downstream alongside the first transfer guide and the second transfer guide while the first part of the parent roll forming on the reel spool remains in nipping engagement with the reeling cylinder until the parent roll is completed.

2. The reel-up of claim 1 wherein each of the upstream and downstream loading arms is mounted to rotate on one of the pair of carriages and rotatable between a first position where the upstream and downstream loading arms engage at most one side of a reel spool, and a second position where the upstream and downstream loading arms do not constrain the movement of a reel spool with respect to the carriages.

3. The reel-up of claim 2 wherein the first primary loading arms, the second primary loading arms, the upstream loading arms and the downstream loading arms are arranged to have a substantially upright position in which they support the reel spool, and a substantially horizontal position, in which they provide for release or a loading of the reel spool.

4. The reel-up of claim 2 wherein the primary loading arms are positioned inside and between the first transfer guide and the second transfer guide.

5. The reel-up of claim 2 wherein the upstream and the downstream loading arms and the carriages are located outside the first transfer guide and the second transfer guide.

6. The reel-up of claim 1 wherein the first transfer guide and the second transfer guide have horizontal guide surfaces which extend horizontally and on which a reel spool is arranged to traverse.

7. The reel-up of claim 1 further comprising a secondary drive mounted to one of the carriages and arranged to cause a reel spool in the secondary reeling position to rotate.

* * * * *